US005477902A

United States Patent [19]

Kraeutler

[11] Patent Number: 5,477,902

[45] Date of Patent: Dec. 26, 1995

[54] GOODS-HANDLING DOOR COMPRISING A WIND-RESISTANT FLEXIBLE CURTAIN

[75] Inventor: Bernard Kraeutler, Dunieres, France

[73] Assignee: Nergeco (Societe Anonyme), Dunieres, France

[21] Appl. No.: 130,192

[22] Filed: Oct. 1, 1993

[30] Foreign Application Priority Data

Oct. 2, 1992 [FR] France ..... 92 11669

[51] Int. Cl.[6] ..... E06B 9/06

[52] U.S. Cl. ..... 160/84.06; 160/264; 160/266

[58] Field of Search ..... 160/264, 266, 160/267.1, 272, 273.1, 270, 274, 84.1 E, 84.1 R

[56] References Cited

U.S. PATENT DOCUMENTS

| | | | |
|---|---|---|---|
| 516,762 | 3/1894 | Burrowes | 160/264 |
| 1,033,224 | 7/1912 | Andlauer | 160/264 X |
| 2,839,135 | 6/1958 | Anderson . | |
| 4,934,437 | 6/1990 | Kraeutler | 160/264 X |
| 4,938,273 | 7/1990 | Dabbelman et al. | 160/84.1 E |

FOREIGN PATENT DOCUMENTS

| | | | |
|---|---|---|---|
| 0405093 | 1/1991 | European Pat. Off. . | |
| 148864 | 10/1935 | Germany | 160/264 |
| 4007280 | 8/1991 | Germany . | |
| 1004297 | 9/1965 | United Kingdom | 160/84.1 E |

*Primary Examiner*—Blair M. Johnson

*Attorney, Agent, or Firm*—Sughrue, Mion, Zinn, Macpeak & Seas

[57] ABSTRACT

A fast-opening and fast-closing goods-handling door for allowing vehicles to pass therethrough includes a foldable or rollable flexible curtain, the edges of which are guided in respective slideways, and which are retained therein by means of retaining carriages guided by rails received in the slideways. According to one aspect of the goods-handling door, the carriages are able to leave the rails. The goods-handling door is further characterized in that it includes a coupling device for coupling the curtain to the carriages, and at least one stress-distribution device for distributing the stresses exerted on the edges of the curtain by the carriages when the door is subjected to detrimental forces.

2 Claims, 4 Drawing Sheets

GOODS-HANDLING DOOR COMPRISING A WIND-RESISTANT FLEXIBLE CURTAIN

BACKGROUND OF THE INVENTION

1. Field of the Invention

The present invention relates to a goods-handling door allowing vehicles and pallet trucks to pass therethrough and comprising a wind-resistant flexible curtain which has its opposite edges held in guides or slideways.

2. Discussion of Related Art

There are several different types of opening systems for flexible-curtain doors, and such opening systems can be put into two categories. First, the door may be opened by the curtain being raised vertically, either by being rolled up around a shaft, or by being folded like a concertina. Second, the door may be opened by the curtain (comprising one or more portions) being moved in translation horizontally.

In all cases, each of those types of opening systems comprises a flexible curtain and either one horizontal slideway (optional in the case of a door that moves in translation horizontally) or two slideways that are vertical or horizontal depending on the type of opening system.

In certain types of doors, the flexible curtain includes one or more reinforcing bars for stiffening the curtain. In general, such bars, or at least some of them, penetrate into the slideways so as to prevent the curtain from moving out of its plane when the curtain is subjected to thrust.

Unfortunately, a vehicle might accidentally hit the curtain. This might tear the curtain or distort one or more bars which must then be replaced. The door might have to remain blocked out of order as a result of such an accident.

SUMMARY OF THE INVENTION

A particular object of the present invention is to provide a door comprising a flexible curtain, the door being particularly but not exclusively a large door, the edges of the flexible curtain being guided in slideways, and the door being organized to withstand high pressures due to high winds, without coming out of its slideways, but also having safety means to protect it against any localized impact on the door, e.g., an impact from a vehicle, so as to prevent the door from being torn and so as to prevent the slideways from being distorted.

U.S. Pat. No. 2,839,135 to Anderson discloses a roller door constituted by rigid slats that are hinged together. At least some of the slats have carriages at their ends, which carriages slide in slideways such that the carriages cannot come out therefrom. The door is designed to withstand high winds. If the door receives a localized impact, e.g., from a truck, the slat that receives the impact is distorted or torn, or the slideway is distorted. In all cases, repair work is necessary, with the door remaining blocked for some time.

The present invention provides a door comprising a flexible curtain having its edges guided in slideways, and held in the slideways by retaining carriages, the door being characterized in that it includes coupling means, and stress-distribution means for distributing the stresses exerted on the edges of the curtain by the carriages when the door is subjected to forces.

The distribution means may be transverse strength elements constituted by stiffening bars for stiffening the curtain, respective retaining carriages being fixed to the ends of at least some of the bars, it being possible to interconnect the bars via flexible straps that are advantageously fixed to the curtain. The distribution means may also be constituted by flexible straps fixed to the curtain transversely, respective retaining carriages being fixed to the ends of at least some of the straps. The distribution means may also be constituted by flexible straps fixed along the edges of the curtain, the retaining carriages being fixed at intervals along such straps.

According to a characteristic of the invention, the distribution means are connected to the carriages via respective mechanical couplings that are adapted so that they come undone under the effect of a determined force.

In an advantageous embodiment of the present invention, a safety element that breaks in the presence of a determined force is interposed between each retaining carriage and the force-distribution means. The safety element may be a releasable or breakable element, such as a shearable pin, or breakable bolts or rivets, that are easy to replace in the event of breakage, without any disassembly being required.

German Patent DE-40 07 280 discloses a roller door in which the load bar is extended at either end by slide parts which penetrate into side slideways. In an embodiment of that door, the slide parts are connected to the load bar via breakable portions adapted to break in the event of an impact on the load bar.

In order to fix the slide part to the load bar, the breakable portion is extended by a coupling element which is bolted to the load bar. In the event that the breakable portion breaks, the entire assembly comprising the slide part, the breakable portion, and the coupling element has to be replaced after unbolting the coupling element.

Choosing a pin as the coupling element offers the advantage that its mechanical strength can be defined accurately. As a result, the pins can be machined so that they withstand strong winds, while nevertheless breaking under the effect of a localized thrust of a certain force. Moreover, it is possible to change a pin without using any special tool. In addition to providing improved reliability, the time during which the door is blocked is shortened.

The curtain slideways prevent wind from penetrating directly through the guided edges of the door. Moreover, it is easy to fit a sealing element to the slideways on at least one side of the curtain, thereby forming an effective barrier to wind. Furthermore, with a vertically-raisable door, the slideways constitute the uprights of the structure supporting the cross-beam in which the roll-up mechanism or the folding mechanism is mounted.

BRIEF DESCRIPTION OF THE DRAWING

Other characteristics, advantages and features appear from the following description of an embodiment of the invention given by way of non-limiting example and with reference to the accompanying drawings, in which.

DESCRIPTION OF PREFERRED EMBODIMENTS

The embodiment described below with reference to FIGS. 1 and 2 relates to a goods-handling door comprising a flexible curtain that can be raised vertically, but the present invention is equally applicable to a goods-handling door that moves in horizontal translation. Therefore, the embodiment described is in no way limiting.

A goods-handling door comprising a vertically-raisable flexible curtain is provided with two vertical side uprights forming slideways on which a lintel-forming cross-beam is generally mounted.

Figure 1:
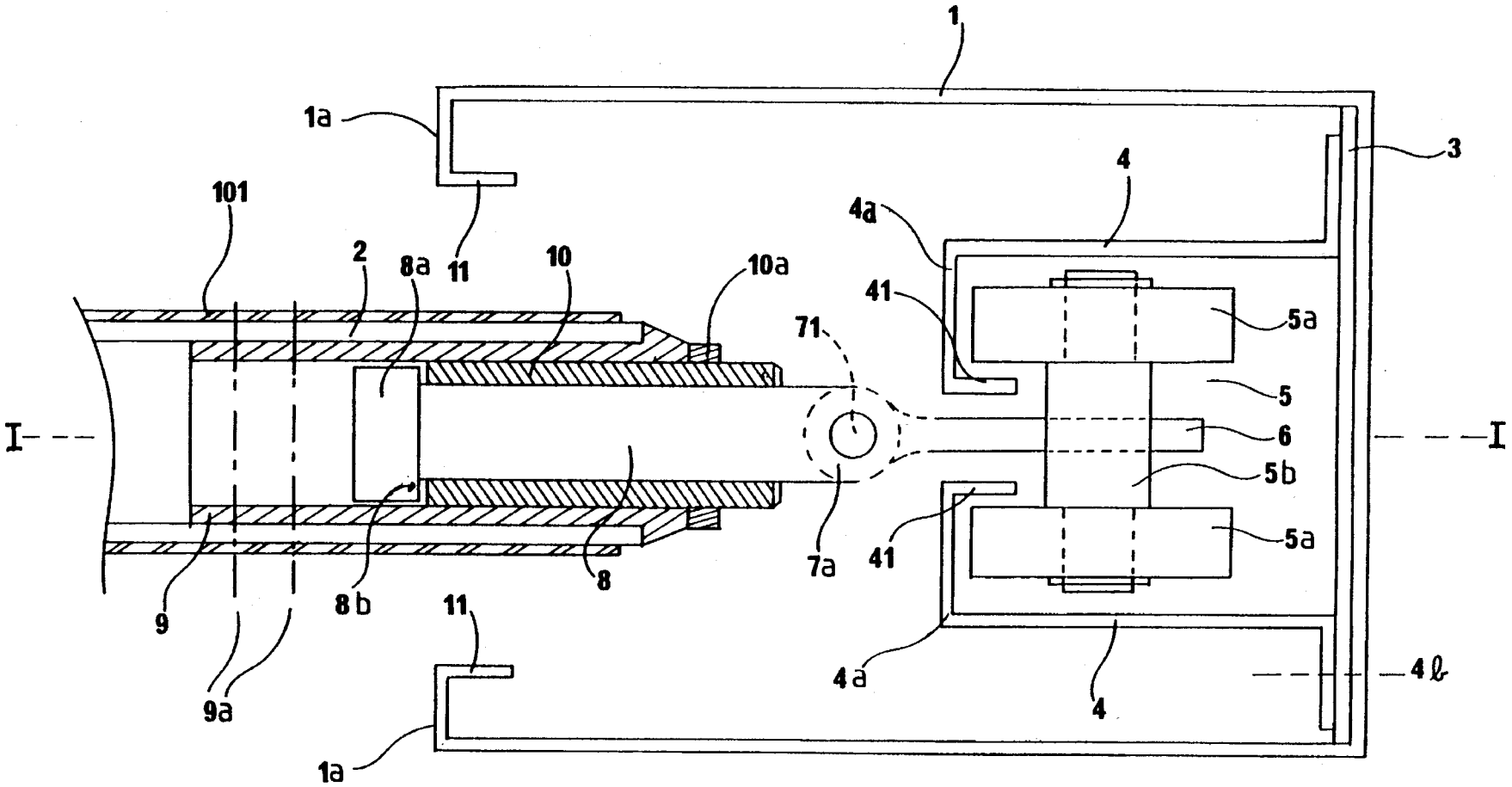
FIG. 1 a sectional view through a portion of a flexible-curtain door of the invention on a horizontal plane containing the longitudinal axis of a reinforcing bar.
Figure 2:
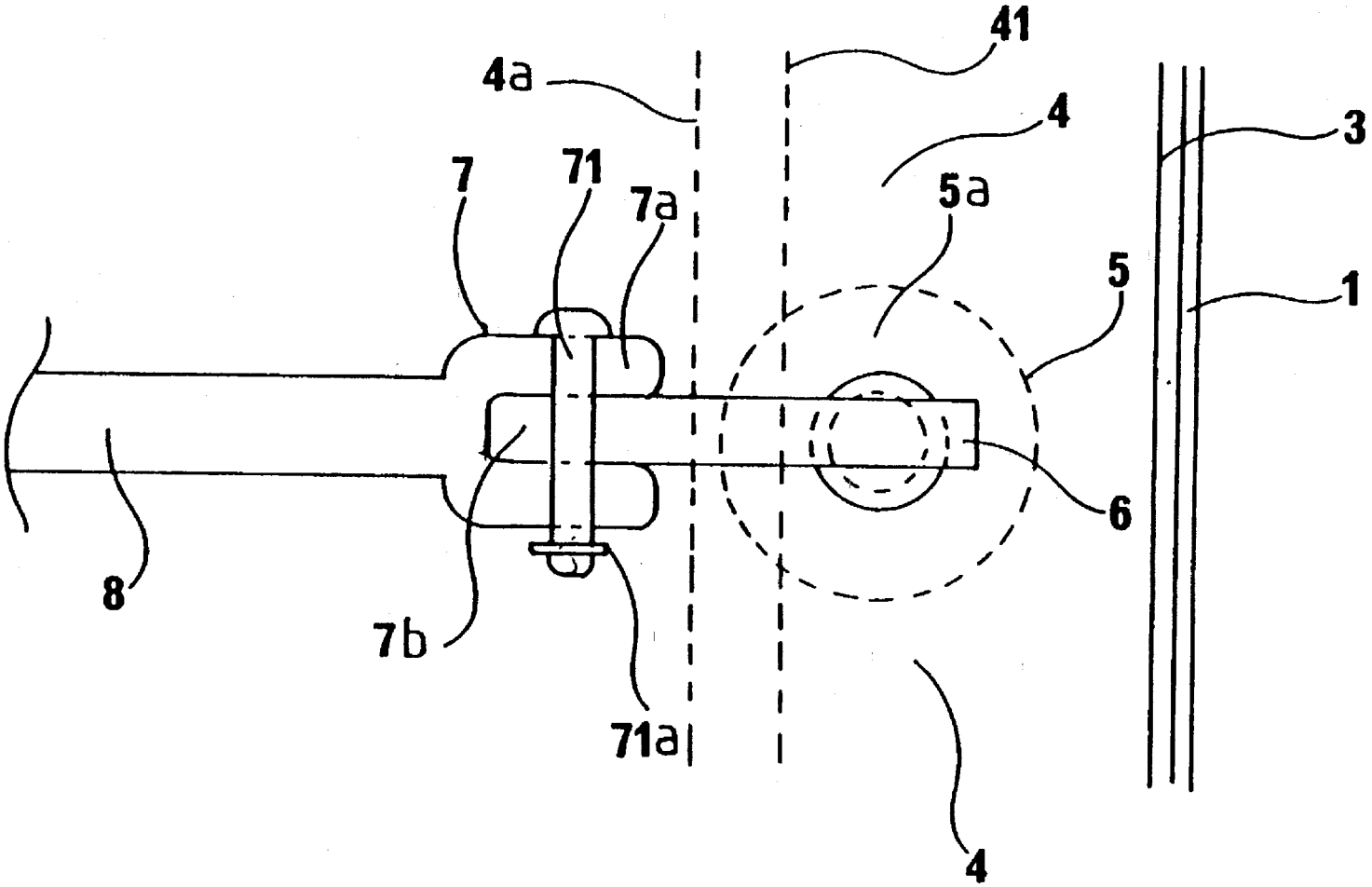
FIG. 2 is a sectional view through the portion of door shown in FIG. 1 taken on line I—I.

FIGS. 1 and 2 show one of the two uprights of a vertically-raisable door, which upright serves as a slideway 1 for guiding the flexible curtain which is stiffened by reinforcing bars 2 that are housed in the curtain 101 and that have their ends penetrating into the slideway 1. The slideway 1 is constituted by a vertical channel-section post having two rims 1*a* whose purpose is to stiffen the structure of the upright. The rims 1*a* are also channel-section and they have respective facing walls 11 which facilitate guiding the end of the reinforcing bar 2 in the slideway A reinforcing plate 3 is welded, riveted, or screwed inside the slideway 1, on the wall forming the web of the channel-section post, so as to provide a strong base for a retaining rail 4 on which considerable stresses are exerted. The retaining rail 4 is constituted by two section members that are symmetrical about line I—I (see FIG. 1), and that are mounted on the reinforcing plate 3, e.g., by means of nuts and bolts 4*b*, so that the rail can easily be removed to gain access to the inside thereof. The slideway-forming retaining rail 4 is provided with a longitudinal slot and with two front walls 4*a*, one on either side of the slot, on which walls a carriage 5 runs, the carriage being equipped with two wheels 5*a* mounted on an axle 5*b*. Like the slideway 1, the retaining rail 4 has two facing rims 41, one on either side of the longitudinal slot. The purpose of the rims 41 is to limit the degree of freedom over which the carriage 5 is free to move inside the retaining rail 4, and also to stiffen the structure of the retaining rail 4.

The carriage 5 has a rod 6 passing through the axle 5*b* which interconnects the two wheels 5*a*, and the carriage is connected to the end of a reinforcing bar 2 via a hinge 7 constituted by two elements 7*a* and 7*b*, element 7*a* being secured to the reinforcing bar 2, and element 7*b* being secured to the carriage via the rod 6. Element 7*a* of the hinge 7 has a Y-shaped section on line I—I, element 7*b* of the hinge 7 being inserted into the Y. The elements 7*a* and 7*b* have bores which are in alignment, and in which a pin 71 constituting the hinge pin of the hinge 7 is inserted. When the curtain is exposed to high winds, stresses are transmitted to the carriages with forces being concentrated. The bar 2 distributes the forces over the entire width of the door, thereby preventing the curtain from tearing in the vicinity of the carriages. Transmission and distribution straps for transmitting and distributing the forces, which straps are perpendicular to the bars, may also be disposed between the bars, the straps being glued or sewn to the curtain.

In an advantageous embodiment of the present invention, the pin 71 is adapted to break when a predetermined force that is perpendicular to the curtain is applied to the reinforcing bar 32, so that the reinforcing bar 2 is released from its carriage 5. The pin 71 is machined so as to withstand strong winds because the force is distributed over the entire curtain, and so as to break under the effect of a localized thrust of a certain force which is exerted only on one bar or, at the most, on two bars. The pin 71 may be provided with a keeper 71*a* so as to prevent the pin 71 from coming out accidentally.

While the structure of the door is quite capable of withstanding the thrust of the wind without being distorted, an impact on the bar might cause the carriage to be torn out or the upright of the door to be distorted.

There are two advantages with having a removable and breakable pin as the coupling element. First, it is easier to determine the rupture threshold (i.e., the mechanical strength). Second, replacing the pin does not require a specialized technician, and as a result, the door is blocked out of order for a short time only.

The reinforcing bar 2 is hollow, and has overall flexibility that is sufficient to enable it to come out from at least one slideway 1 under the effect of a collision with the flexible curtain. In this embodiment, the reinforcing bar 2 is a tube and each of its ends receives a respective rod 8 secured to element 7*a* of the respective hinge 7.

FIG. 1 also shows a section through an embodiment of an adjustment device for adjusting the extent to which the rod 8 penetrates into the bar, i.e., means for adjusting the length of the bar, and for setting the tension thereof in the presence of wind.

At its free end opposite from the hinge 7, rod 8 is provided with a larger-diameter head 8*a*, and in this way has a shoulder 8*b* via which the head can be retained. For the purposes of retaining the head, a sleeve 9 is received in the end of the bar 2, and the sleeve may be held therein by means of pins 9*a* represented diagrammatically. The diameter of the head 8*a* is such that the head can slide freely inside the sleeve 9. The inside surface of the sleeve 9 is provided with a thread, and a bushing 10 whose outside is provided with a thread may be screwed into the sleeve. The inside diameter of the bushing 10 is such that the rod 8, but not the head 8*a*, can be received freely therein, with the shoulder 8*b* of the head bearing against the end of the bushing. A lock nut 10*a* enables the bushing to be locked in the chosen position, i.e., the lock nut makes it possible to choose the distance between the end of the bar 2 and the hinge pin of the hinge 7.

Figure 3:
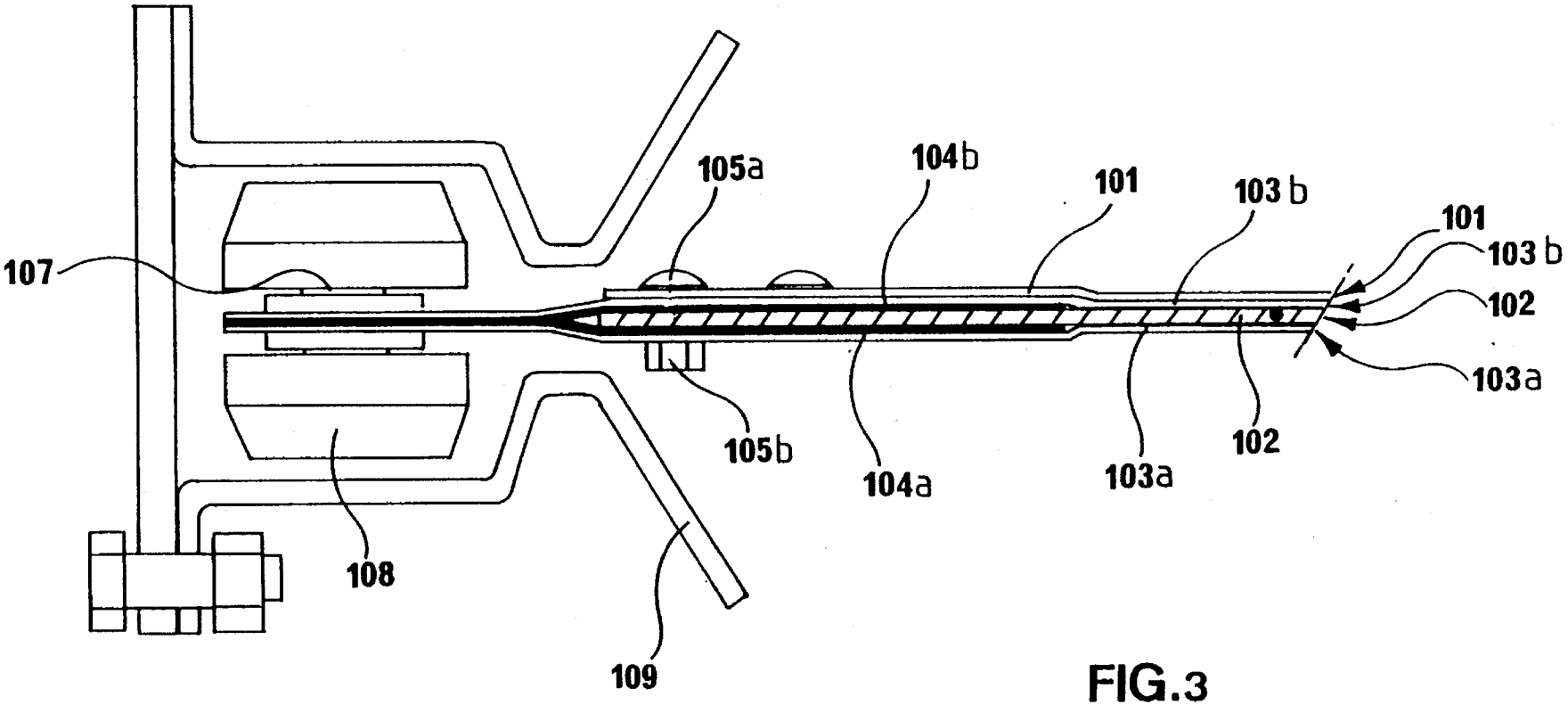
FIG. 3 is a sectional view that is analogous to that of FIG. 1 for another embodiment of the invention, and that is taken on line III—III shown in FIG. 4.
Figure 4:
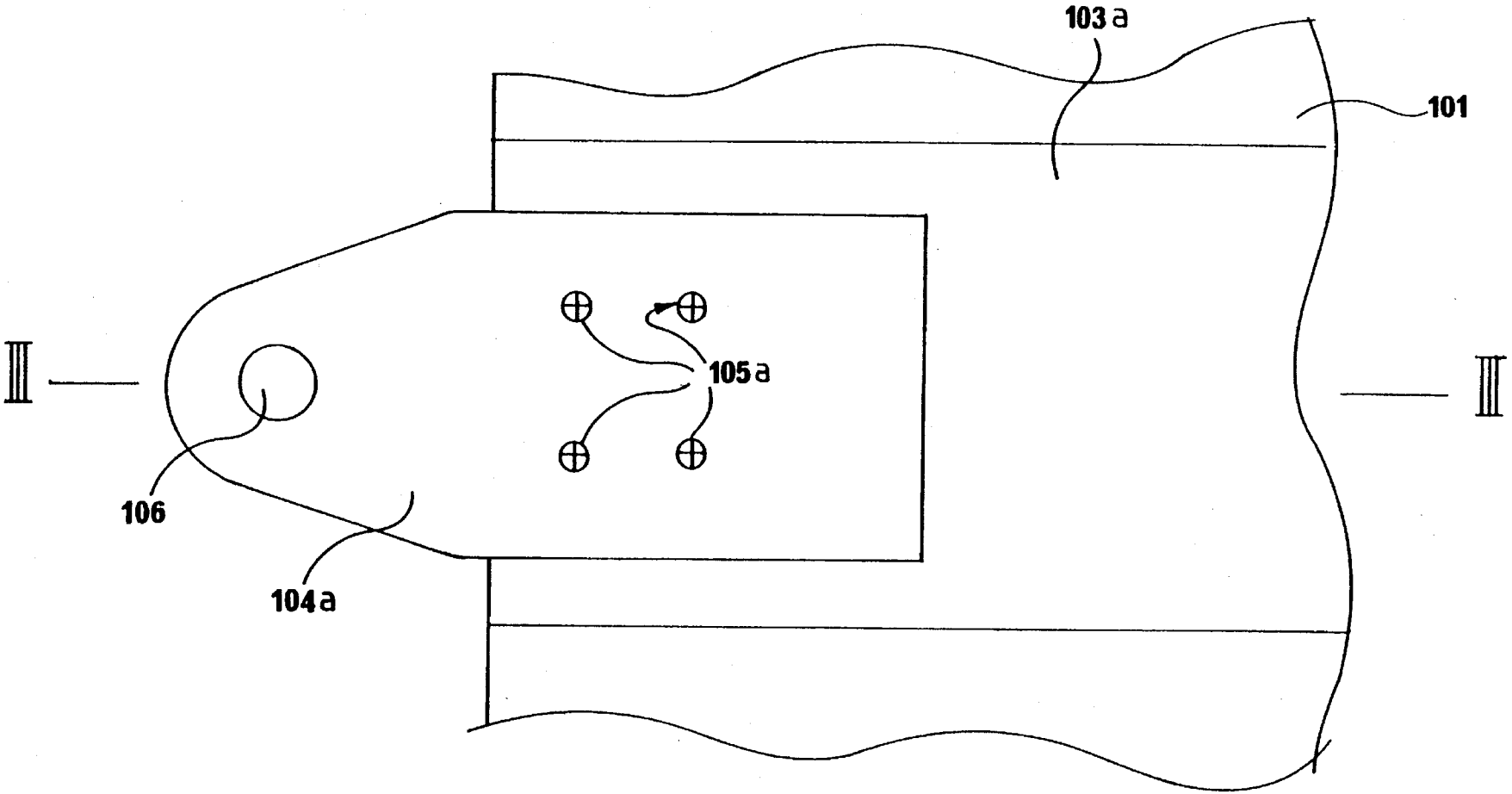
FIG. 4 is an elevational view of the edge of the FIG. 3 curtain, at a retaining carriage.

Another embodiment of the invention is shown in FIGS. 3 and 4 relating to a roller curtain.

At various heights, the flexible curtain 101 is equipped with respective polyester straps 102 so as to provide transverse strength between the edges of the curtain. Each strap is disposed inside a sheath constituted by two plastic sheets 103*a* and 103*b* that are a slightly wider than the strap, and that are welded together along their edges, the resulting assembly being welded or glued to the flexible curtain 101. In this example, a metal coupling part is constituted on the edge of the curtain by two rigid tabs or plates 104*a* and 104*b*, e.g., made of steel, disposed one on either side of the strap, and clamped thereagainst by nuts and bolts 105*b* and 105*a*. The tabs are provided with respective openings 106 for passing the axle 107 of the wheels 108. Another example of a slideway 109 is shown in section in FIG. 3. The above-described layout enables the completely-flexible curtain to be rolled up evenly, and the steel tabs can be placed on the edge of the shaft around which the curtain is rolled, and can ensure that the wheels are placed correctly in the slideways when the curtain is being unrolled. The gaps between the various straps distributed over the height of the curtain may, if necessary, be unequal so as to prevent the wheels from being superposed, thereby hindering the rolling up of the curtain. The force exerted by the wind on the curtain is distributed over the entire width via the straps 102, and is thus transmitted to the slideways via the wheels.

In an advantageous embodiment of the invention, safety means are interposed between the retaining wheels and the stress-distribution means, so as to separate the wheels from the distribution means in the event of excessive or abnormal force, e.g., force concentrated on a single strap, e.g., under the impact of a vehicle. In this embodiment, the safety means may be implemented by using shearable bolts, e.g., made of plastic, that shear under a certain shear force, for the clamping bolts 105 that hold the steel tabs 104 together. These means are simple and, in the event that they break, the bolts can be replaced immediately without a specialist being required.

I claim:

1. A fast opening and fast-closing goods-handling door for allowing vehicles to pass therethrough, said door comprising a flexible curtain, the edges of the curtain being guided in respective slideways, and being retained therein by means of retaining carriages guided by rails received in the slideways, without the carriages being able to leave said rails, said door being characterized in that it includes coupling means for coupling the curtain to the carriages, and stress-distribution means for distributing the stresses exerted on the edges of the curtain by the carriages when the door is subjected to forces, said door being further characterized in that length-adjustment means are interposed between at least one retaining carriage and the adjacent stress-distribution means.

2. A fast-opening and fast-closing goods-handling door for allowing vehicles to pass therethrough, said door comprising a flexible curtain, the edges of the curtain being guided in respective slideways, and being retained therein by means of retaining carriages guided by rails received in the slideways, without the carriages being able to leave said rails, said door being characterized in that it includes coupling means for coupling the curtain to the carriages, and stress-distribution means for distributing the stresses exerted on the edges of the curtain by the carriages when the door is subjected to forces, wherein said distribution means are transverse strength elements constituted by straps extending from one edge of the curtain to the other, the carriages being operatively coupled to respective ends of at least some of the straps, and wherein said coupling means comprises two rigid plates clamped together at one end against both sides of one of the respective straps, and having fixing means at the other end for fixing to the carriage.

* * * * *